United States Patent [19]

Burysek et al.

[11] 3,948,452

[45] Apr. 6, 1976

[54] OPEN-END SPINNING MACHINE AND METHOD OF OPERATING THE SAME

[75] Inventors: Frantisek Burysek; Milos Mares; Josef Havel, all of Usti Nad Orlici, Czechoslovakia

[73] Assignee: Vyzkumny Ustav Bavlnarsky, Usti nad Orlici, Czechoslovakia

[22] Filed: Sept. 24, 1973

[21] Appl. No.: 400,324

[30] Foreign Application Priority Data

Sept. 25, 1972 Czechoslovakia ..... 6506-72

[52] U.S. Cl...... 242/18 A; 242/18 PW; 242/35.5 A

[51] Int. Cl.[2]..... B65H 67/04

[58] Field of Search..... 242/18 A, 18 PW, 35.5 R, 242/35.5 A

[56] References Cited

UNITED STATES PATENTS

| | | | |
|---|---|---|---|
| 2,772,054 | 11/1956 | Herele et al. | 242/18 A |
| 2,905,402 | 9/1959 | Foller et al. | 242/18 A |
| 3,001,732 | 9/1961 | Hill, Jr. et al. | 242/18 A |
| 3,279,709 | 10/1966 | Carlson et al. | 242/18 A |
| 3,355,117 | 11/1967 | Gerhardt et al. | 242/18 A |
| 3,370,798 | 2/1968 | Hagihara et al. | 242/18 A |
| 3,521,826 | 7/1970 | Schmick | 242/18 A |
| 3,561,688 | 2/1971 | Hagihara et al. | 242/18 A |
| 3,695,521 | 10/1972 | Torii et al. | 242/18 A |
| 3,791,126 | 2/1974 | Kose et al. | 242/18 A UX |
| 3,820,730 | 6/1974 | Endo et al. | 242/35.5 R |

FOREIGN PATENTS OR APPLICATIONS

| | | | |
|---|---|---|---|
| 1,104,156 | 2/1968 | United Kingdom | 242/18 A |

*Primary Examiner*—Stanley N. Gilreath
*Attorney, Agent, or Firm*—Michael J. Striker

[57] ABSTRACT

An open-end spinning machine, is operated by continuously advancing a yarn towards a take-up station at which it is wound onto a bobbin rotating at a predetermined speed, so that a yarn package forms on the bobbin and the latter eventually becomes full. As the bobbin approaches a condition of fullness, an empty bobbin is rotated adjacent to it and is accelerated until it reaches the speed at which the full bobbin rotates. The yarn which advances onto the full bobbin is then severed from the yarn package on the latter, to provide a free yarn end which is inserted into one axial end of the rotating empty bobbin, to be engaged and entrained by the latter whereby winding of the free yarn end onto the empty bobbin commences. The full bobbin is now removed from the station and is replaced with the rotating empty bobbin.

20 Claims, 25 Drawing Figures

OPEN-END SPINNING MACHINE AND METHOD OF OPERATING THE SAME

BACKGROUND OF THE INVENTION

The present invention relates generally to the textile art, and more particularly to a textile machine, and to a method of operating the same.

Still more particularly, the present invention relates to a method of exchanging full bobbins for empty ones in an open-end spinning machine, and to an apparatus for carrying out the method.

In many textile machines, yarn is wound onto a bobbin which is usually in form of a cylindrical or conical tube. When the bobbin is full, that is when it has a so-called "yarn package" formed thereon, the winding of further yarn onto it must of course be terminated. This is done, and thereupon the full bobbin is removed from the take-up station at which it has been rotated to wind yarn onto it, and an empty bobbin is put in its place. With the ever increasing speed at which modern equipment of this type operates, and with economic considerations dictating the efficiency requirements which are made of such machines, it is of course in most instances not practical to rely upon manual removal of the full bobbin and its replacement with an empty one, at least not usually. The art has therefore developed automatic devices for exchanging full bobbins for empty ones. Many of these devices are quite successfully used, for instance with yarn spooling machines wherein the yarn supply to the winding mechanism will be stopped immediately after the winding operation has been interrupted. As a rule, these prior-art devices are constructed as units which travel along the respective machine, and are provided with a mechanism which withdraws the full bobbin from the bobbin-driving drum, and with a mechanism which supplies an empty bobbin from a magazine.

The basic principle of operation of many of these devices of the prior art is that the yarn withdrawal is interrupted when the winding-up of yarn onto the full bobbin is terminated, and remains interrupted until the empty bobbin is mounted in the machine and the free yarn end which was created by severing the yarn from the package of yarn on the full bobbin, has been connected with the empty bobbin.

However, there are many instances where these prior-art devices are not suitable for use. For example, open-end spinning machines produce yarn in a continuous flow and unless the yarn will be continuously taken up, that is will be taken up without interruption, the yarn being produced will become entangled and will have to be discarded. In these machines, in which it is not possible to interrupt the taking-up operation so that the same must continue even as the full bobbin is replaced with an empty one, the prior-art automatic bobbin changing equipment cannot be utilized.

A proposal has been made in the prior art to provide such a piece of equipment which can be used even with open-end spinning machines and similar textile machines wherein yarn is supplied continuously and at a constant rate. This prior-art proposal utilizes severing means for severing the yarn between the full bobbin and the spinning unit from which the yarn is continuously derived. On the other hand, a negative-pressure mechanism is provided which, during the bobbin changing operation, continuously draws off the yarn being supplied by the spinning unit and carries it away.

This continues until the yarn is engaged by a newly installed empty bobbin and winding of the yarn onto this empty bobbin commences. That amount of yarn which has been drawn off by the negative-pressure mechanism during the time at which winding onto the previous full bobbin was interrupted and at which winding onto the new empty bobbin has commenced, is severed and is discarded as waste material. Since obviously the production of large amounts of waste material represent an economic loss, it is desired that the waste yarn length be kept as short as possible. Evidently, for this reason it is desirable that the bobbin change period also be kept as brief as possible, particularly if high spinning speeds are concerned, that is if the yarn is being produced at a high rate of speed and continuously must be withdrawn as waste material until winding onto a new empty bobbin can commence. However, the speed of bobbin exchange is limited in this prior-art device because the empty bobbin is not supplied until the full bobbin has been withdrawn from its position at the take-up station. Once the empty bobbin has been supplied, it is installed at the take-up station by being forced on a bobbin-driving drum and only now will be empty bobbin begin to rotate and come up to speed. Evidently, during all this time period, yarn which is continuously being produced by the spinning until will go to waste as it is drawn off by the negative-pressure mechanism. Aside from this drawback, this prior-art device mentioned above does not provide for the formation of yarn reserve on the empty bobbin, which is also disadvantageous.

The industry is, therefore, still searching for an approach to the problem of exchanging a full bobbin for an empty one in a textile machine in which yarn is being supplied continuously to the take-up station.

SUMMARY OF THE INVENTION

It is, accordingly, a general object of the present invention to overcome the disadvantages of the prior art and to provide such an improved answer to the problem which has been outlined above.

More particularly, it is an object of the present invention to provide an improved method of replacing the empty bobbins in a textile machine, particularly a textile machine which supplies yarn to the take-up station in an interrupted flow, for empty bobbins.

Another object of the invention is to provide an improved apparatus for carrying out the method.

In keeping with the above objects, and with others which will become apparent hereafter, one feature of the invention resides in the aforementioned improved method, namely a method of operating a textile machine, particularly an open-end spinning machine. In this method, the invention provides for the steps of continuously advancing a yarn towards a take-up station, and winding the advancing yarn at the station onto a bobbin which rotates at a predetermined speed, so that a yarn package forms on the bobbin until the latter is full. An empty bobbin is rotated, and accelerated until it reaches the aforementioned predetermined speed. The advancing yarn is severed from the yarn package on the full bobbin to provide a free yarn end, and the free yarn end is entrained with the rotating empty bobbin, so that winding of the yarn onto the empty bobbin commences. The full bobbin is now replaced at the station with the rotating empty bobbin.

The free yarn is introduced, substantially at the speed at which the yarn is derived from the yarn source, such as a rotary spinning chamber of the textile machine, into the interior of the empty bobbin which rotates at the winding-up speed. The yarn is then bent over the edge at the one axial end of the bobbin, entrapped at this edge, and winding of the yarn onto the empty bobbin commences.

The fact that the empty bobbin is rotated at the winding-up speed during practically the entire bobbin exchanging operation, and that the free yarn end is attached to the empty bobbin so that during the entire bobbin changing period the yarn can be wound onto the empty bobbin, makes it possible to perform the exchange of the full bobbin for the empty one without interfering in any way with the continuous advancement of the yarn which is derived from a source, such as the aforementioned rotary spinning chamber. Moreover, it eliminates variations in yarn tension and it overcomes the heretofore so uneconomically high amount of yarn waste. Because of all of this, the actual time required for the bobbin exchange operation need not be as short as would otherwise be necessary, even if the yarn is being supplied to the take-up station at relatively high speeds. This is advantageous because excessive shortening of the bobbin exchange period would be undesirable, due to the inertial forces which are generated in the exchanging mechanism. Moreover, at lower bobbin exchanging speeds it is unnecessary to make the various components of the apparatus very strong, so that materials are saved which would otherwise be required in the manufacture of strong components, and because less strong components will weigh less, power requirements for driving the movable ones of the components are reduced.

Furthermore, the present invention has the additional advantage that the introduction of the free yarn end into the interior of the rotating bobbin, and the entrainment of the yarn by engagement with the bobbin edge, make it possible to form on the bobbin a yarn reserve which is readily available later on when the yarn package formed on the full bobbin is to be used for other operations, for instance when the yarn package is utilized for textile producing steps.

The apparatus for carrying out the novel method comprises a combination of first means for engaging a first bobbin and rotating the same at a predetermined speed, and second means for continuously advancing a yarn to the first bobbin so that the yarn can be wound onto the same. Third means is provided for rotating an empty second bobbin at the aforementioned predetermined speed, and fourth means serves for severing the advancing yarn from the yarn on the first bobbin when a yarn package has been formed on the later, so as to form a free yarn end on the advancing yarn. Fifth means supplies the free yarn end to the rotating second bobbin for engagement and taking-up by the same, and sixth means replaces the first bobbin having the yarn package, with the rotating second bobbin.

The mechanism which supplies the empty bobbin, and the yarn severing means, utilize a mechanism for predriving the empty bobbin to bring it up to the aforementioned predetermined speed so that the bobbin will rotate at the speed before it is installed in the take-up station of the machine. The fifth means inserts the free yarn end into the interior of the predriven empty bobbin, which latter is provided on the edge of one of its axial ends with yarn entrapping means which entraps and thus entrains the yarn.

The empty-bobbin predriving mechanism may utilize the empty-bobbin supplying mechanism and a bobbin driving drum, with the bobbin supplying mechanism forming means for preliminarily forcing the empty bobbin against the bobbin driving drum.

The empty bobbin predriving mechanism may further be provided with an auxiliary drum or endless belt, either of which is driven at the predetermined winding speed, and the empty bobbin supplying mechanism may serve to force the empty bobbin during the bobbin exchange operation against the auxiliary drum or the endless belt.

In the two exemplary embodiments mentioned above, the empty bobbin supplying mechanism may be formed with two rolls which are mounted on a spring-loaded lever supported on a bar which is adapted to reciprocate from one extreme position in which the rolls are in their starting position and take the empty bobbin from a magazine, into several intermediate positions in which the rolls force the empty bobbin either against the driving drum alone, or first against the auxiliary driving drum or auxiliary belt, and also against the driving drum, and finally only against the driving drum, and to a second extreme position in which the empty bobbin is engaged by arms and held in its working position. The rolls may be secured against the action of a spring by an abutment which is provided within the path of an extension formed on the spring-loaded lever.

The means for inserting the yarn end into the interior of the empty bobbin may be constituted by a gripper adapted to reciprocate between two extreme positions, one of which is the starting position in which the gripper is located adjacent the take-off rollers which withdraw yarn from the yarn supply and in which the gripper clamps the yarn, while in the second or working position the gripper extends with the clamped yarn end into the interior of the empty bobbin. The gripper may have two jaws, one of which is a stationary jaw and the other of which is a movable spring-loaded jaw the movements of which may be controlled mechanically, pneumatically, hydraulically or electromagnetically. On the other hand, the gripper may also be formed with a body having a V-shaped groove defined between two mutually inclined walls which include with one another an acute self-locking angle. In the case of finer yarn counts, one of the walls bounding the V-shaped groove may be constituted by a spring-loaded plate.

The means for inserting the yarn end into the interior of the bobbin may be formed with an air duct which is provided with a longitudinally extending slot for allowing the yarn to slip off therefrom. The inlet of the duct may be arranged adjacent the take-off rollers while the outlet is arcuately configured so that it can be inserted into the interior of the bobbin. The inlet of the duct may communicate with a tube connected to a source of pressurized medium which serves to introduce the yarn into the duct, or the outlet of the duct may be constituted by a longitudinally slit tube which communicates with a vacuum source for sucking the yarn into the duct.

The means for inserting the yarn end into the interior of the empty bobbin may be a vacuum tube adapted to reciprocate between two extreme positions, namely a starting position in which the inlet of the tube is located adjacent the yarn take-off rollers for aspirating the free end of the yarn into the tube, while in the working position the inlet of the tube together with the aspirated yarn is located in the interior of the empty bobbin. The yarn entrapping means may be formed either as a notch in the bobbin edge, as a roughened part of the bobbin edge, or as a protuberance on the bobbin edge.

The yarn which is entrapped and entrained by the bobbin edge during the yarn reserve formation, may be deflected from a direction perpendicular to the bobbin axis towards the bobbin edge, by a deflector which cooperates with the yarn inserting mechanism. This deflector may be made tiltable from a position from which it deflects the yarn to a position in which it is located beyond the yarn path and does not deflect the yarn.

The yarn severing means may be provided on the yarn inserting means, or could be separate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
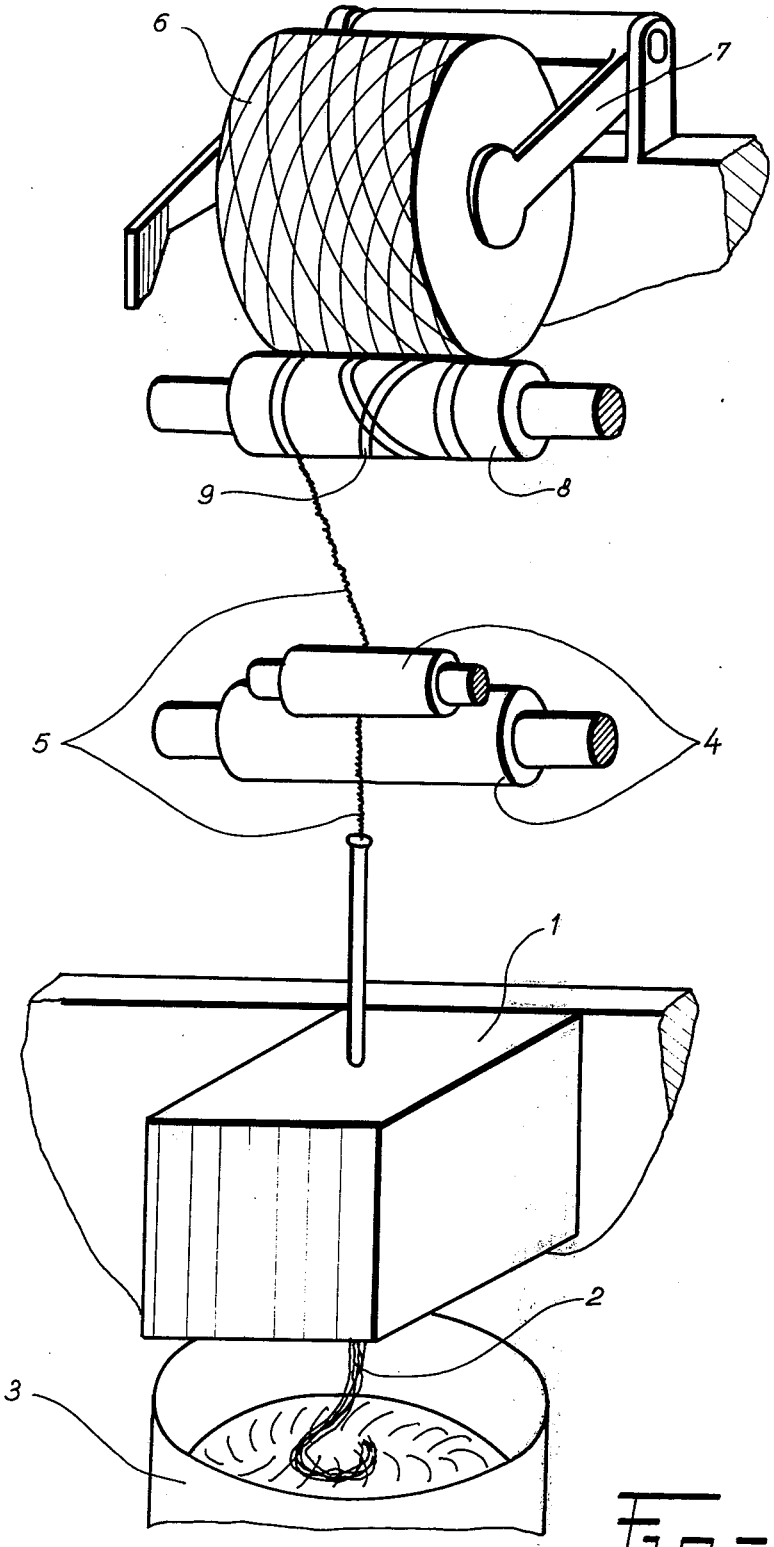
FIG. 1 is a fragmentary perspective view illustrating a working unit of an open-end spinning machine.

Discussing the drawing in detail, and referring firstly to FIG. 1, it will be seen that each working unit of an open-end spinning machine comprises a spinning unit 1 having a spinning rotor or rotary spinning chamber (not shown) which in known manner receives separated fibrous sliver 2 that is withdrawn from a supply 3. The sliver 2 is continuously converted in the spinning unit 1 into a yarn 5 which is continuously withdrawn from the spinning unit 1 by a pair of take-off rollers 4. The thus-withdrawn yarn 5 is wound onto a bobbin 6 which is supported by arms 7. The bobbin 6 with the yarn package which is formed on the same is forced against a yarn traversing drum 8 which imparts the necessary winding speed to the bobbin 6 and is provided with a yarn traversing groove 9 designed to form a cross-wound package on the bobbin 6. This basic type of equipment is well known to those skilled in the art.

Figure 2:
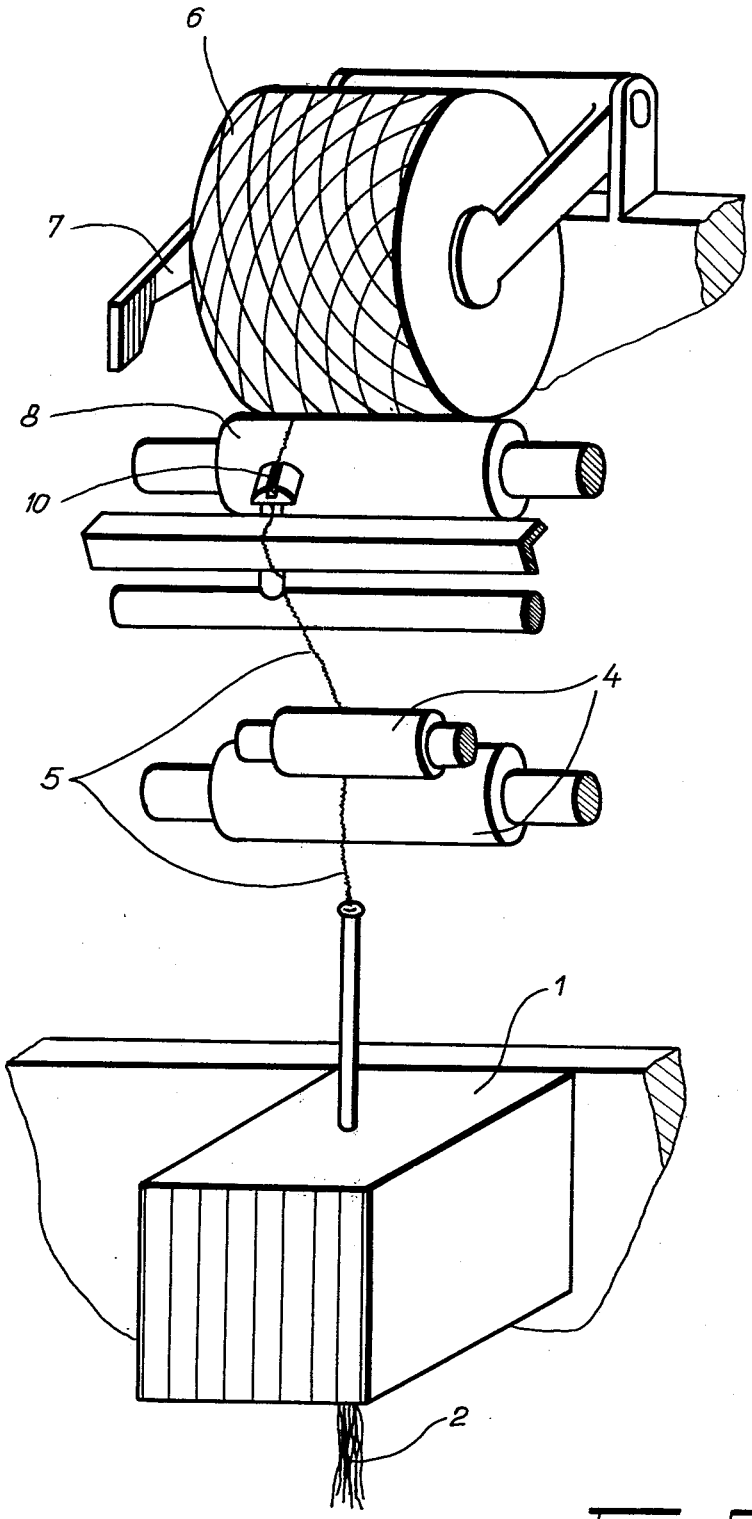
FIG. 2 is a perspective view of a different working unit of an open-end spinning machine.

Another embodiment of a winding device known to those skilled in the art is shown in FIG. 2, wherein the drum 8 serves for driving only the package on the bobbin 6, while the yarn traversing function is assumed by a reciprocatory yarn guide 10. All other components in FIG. 2 correspond to those in FIG. 1 and have like reference numerals.

Figure 3:
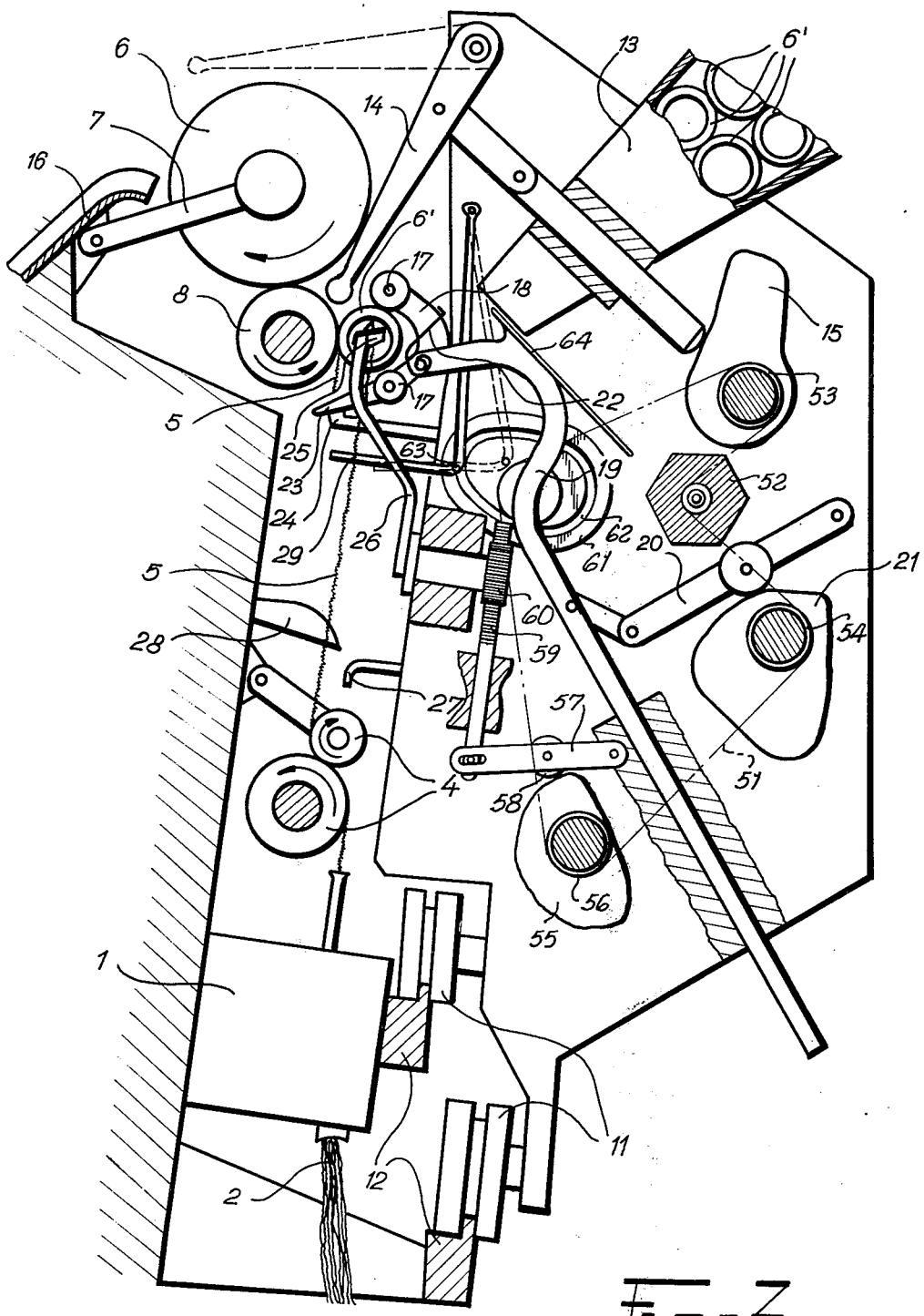
FIG. 3 is a partly sectioned view, illustrating an apparatus according to one embodiment of the present invention, installed on the machine shown in FIG. 1.

FIG. 3 shows an apparatus for exchanging the bobbins 6, and which can be used in the organization of the apparatuses shown in FIGS. 1 and 2. The apparatus in FIG. 3 is made movable along the open-end spinning machine by means of rolls 11 which are adapted to roll along guide rails 12. It comprises a mechanism for removing the full bobbin 6 which has the yarn package formed on it. A bobbin magazine 13 is provided which holds empty bobbins 6' and from which a mechanism provided for this purpose allows the empty bobbins 6' to issue individually. For this purpose the bar 19 supports a plate 64 which in the position of FIG. 3 closes the outlet of the magazine 13 to prevent the lowermost empty bobbin 6' from dropping out. The plate 64 is movable to a lower position (see FIG. 4) in which it frees the magazine outlet to allow the lowermost empty bobbin 6' to drop out under the influence of gravity, and to fall onto rolls 17 which are in their receiving position. The empty bobbins 6' are predriven up to the winding speed by appropriate mechanism during the bobbin changing operation. The yarn 5 is inserted into the empty bobbins 6', and means is provided for severing the yarn section which extends between the full bobbin 6 and the take-off rollers 4 to produce a free yarn end which can be inserted into the next-following empty bobbin 6'.

The full bobbin is removed by a mechanism having an ejecting arm 14 which is controlled by a cam 15, and it has a chute 16 for the full bobbin.

The mechanism for supplying the empty bobbin 6' from the magazine 13 has two rolls 17 which are pivoted on a lever 18, the latter in turn being attached to a reciprocable bar 19 the movements of which are controlled by a cam 21 via a lever transmission 20. The spring 22 is provided which forces the lever 18 in counterclockwise direction.

Figure 4:
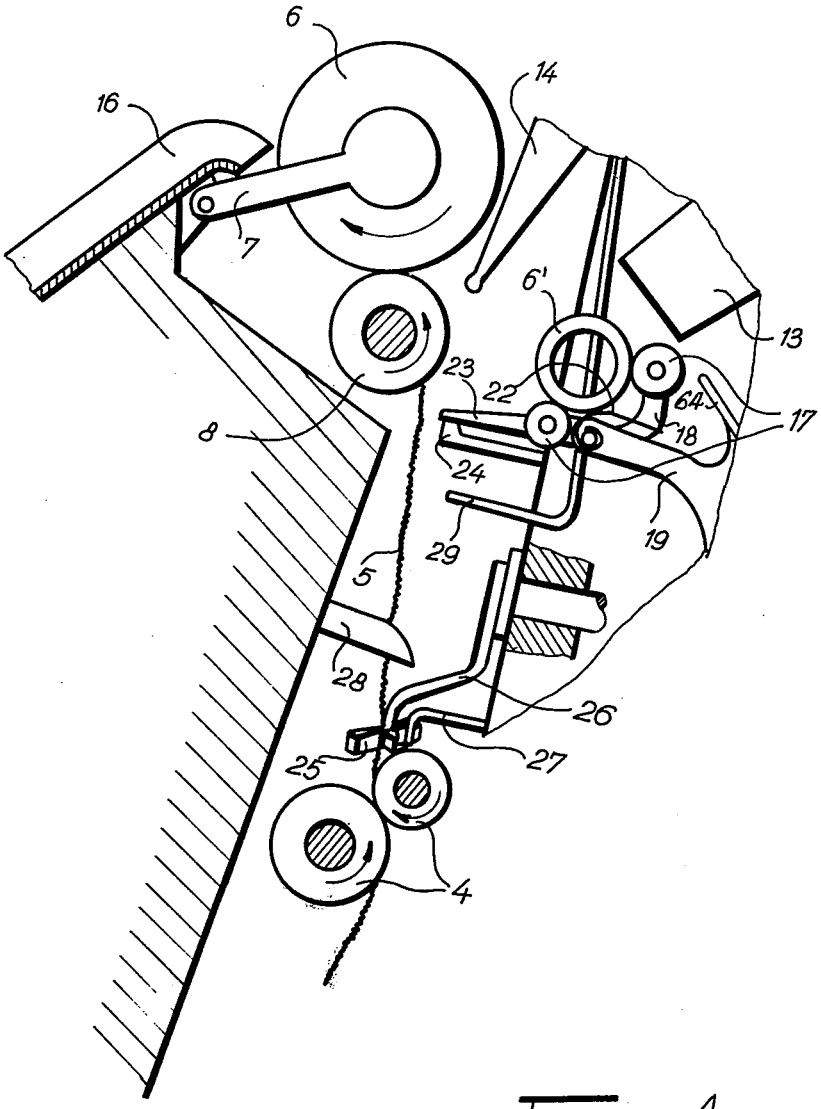
FIG. 4 is a partly sectioned elevational detail view of the apparatus in FIG. 3, showing the bobbin supplying mechanism in one extreme position.
Figure 5:
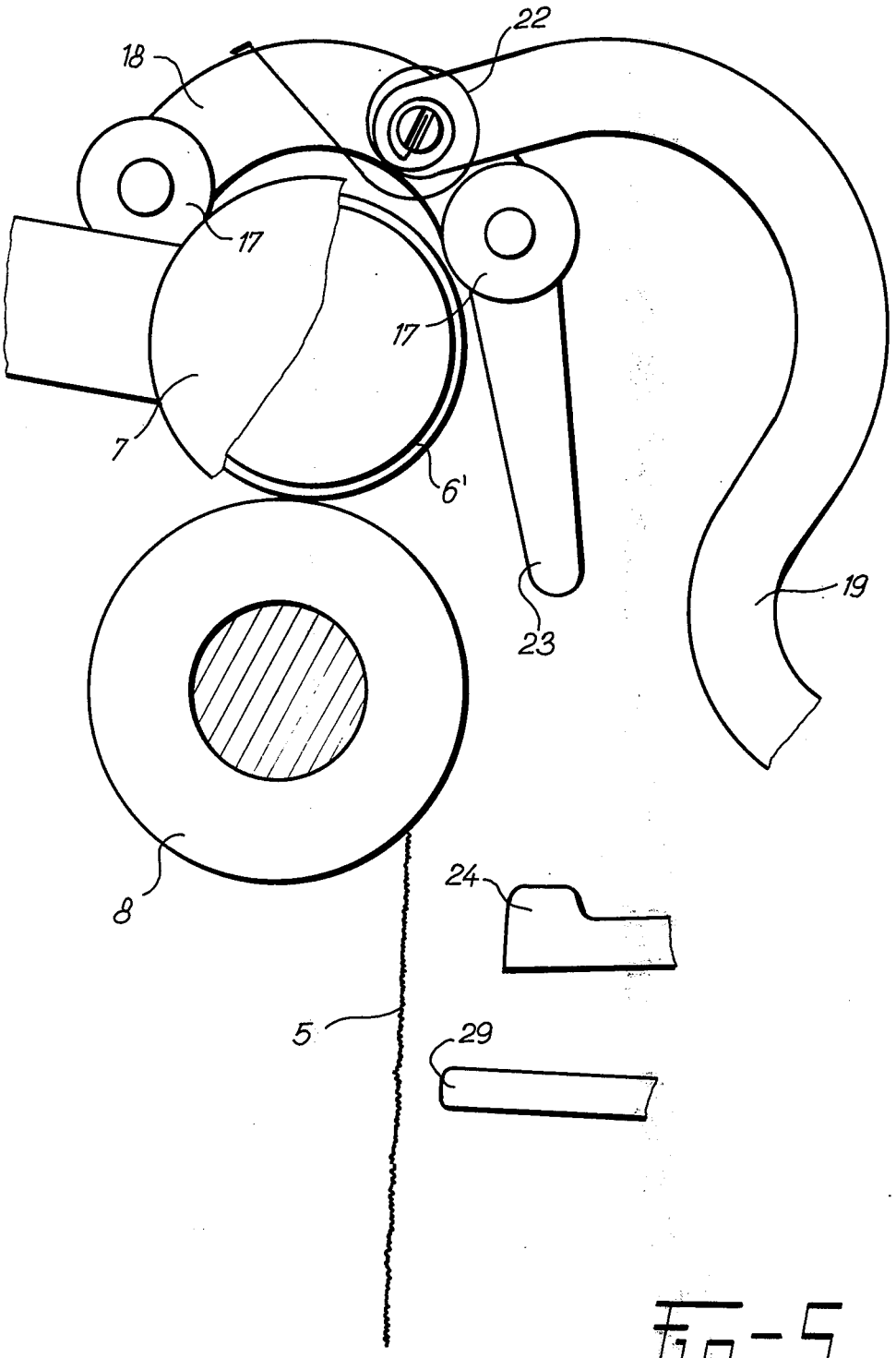
FIG. 5 is a view similar to that in FIG. 4, showing the bobbin supply mechanism in its opposite extreme position, but on an enlarged scale.

FIGS. 3–5 show that the mechanism for supplying the empty bobbin 6' can move from one extreme position in which the rolls 17 are located in their starting position and remove an empty bobbin 6' from the bobbin magazine 13, as shown in FIG. 4, to a position wherein the rolls 17 force the empty bobbin 6' against the yarn traversing drum 8 as shown in FIG. 3. This is an intermediate position from which the mechanism can move to the opposite extreme or end position shown in FIG. 5, to supply the empty bobbin 6' to the arms 7, to be seized by the same.

The rolls 17 are to be arrested in their starting position against the action of the spring 22, and for this purpose the lever 18 is provided with an extension 23 which can be engaged by an abutment 24.

Since the empty bobbin 6' is to be predriven and brought up to the normal winding speed during the changing operation, a mechanism is provided for effecting such predriving. This mechanism utilizes the aforementioned mechanism for supplying the empty bobbin 6', including the yarn traversing drum 8 against which the bobbin 6' is forced during the bobbin changing operation.

Figure 7:
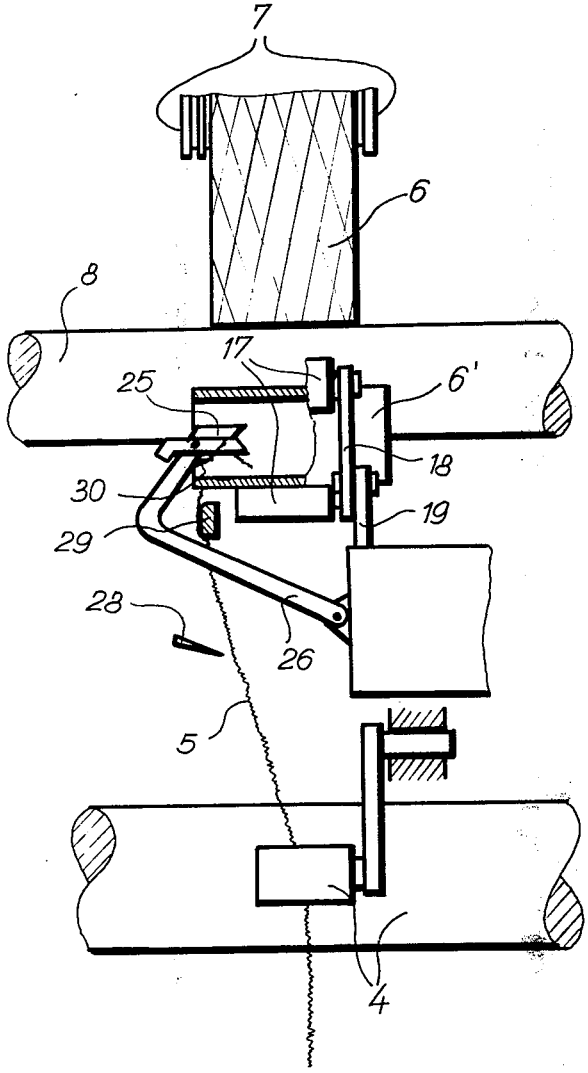
Figure 10:
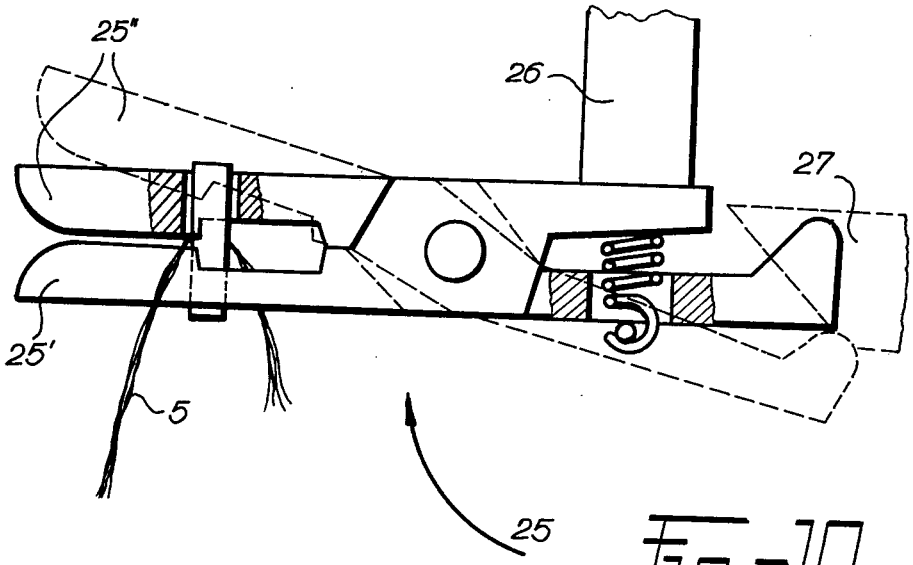
FIG. 10 is a detailed partly sectioned side view showing a yarn gripper according to the invention.

To insert the yarn 5 into the empty bobbin 6', a gripper 25 is provided (see also FIG. 10 for details) on an arm 26 which can reciprocate between two extreme positions. One of these is shown in FIG. 4, and it will be seen that the gripper 25 in this position is located adjacent the take-off rollers 4. The other or working position is shown in FIG. 7, and it will be seen that the gripper 25 enters the interior of the empty bobbin 6' to reach this position. As shown particularly clearly in FIG. 10, the gripper 25 in this embodiment has one stationary jaw 25' and a movable spring loaded jaw 25''. The movable jaw is urged against the stationary jaw 25' in normal operation, and can be moved away from it. Movement of the jaw 25' is blockable by an abutment 27. The movable jaw 25' may be moved electromagnetically or pneumatically, if desired. The yarn being wound onto bobbin 6 to form a cross-winding thereon reciprocates in a plane normal to the drawing plane, the intersection of these two planes being constituted by the line represented by the yarn 5. The posterior gripper plane (see FIG. 4) is inclined relative to the plane of reciprocation so that the gripper 25 can pass by the yarn which slides on the posterior gripper wall during such passage.

The means for severing the yarn 5 is constituted in the particular embodiment under discussion, by stationary cutting blade 28.

Figure 6:
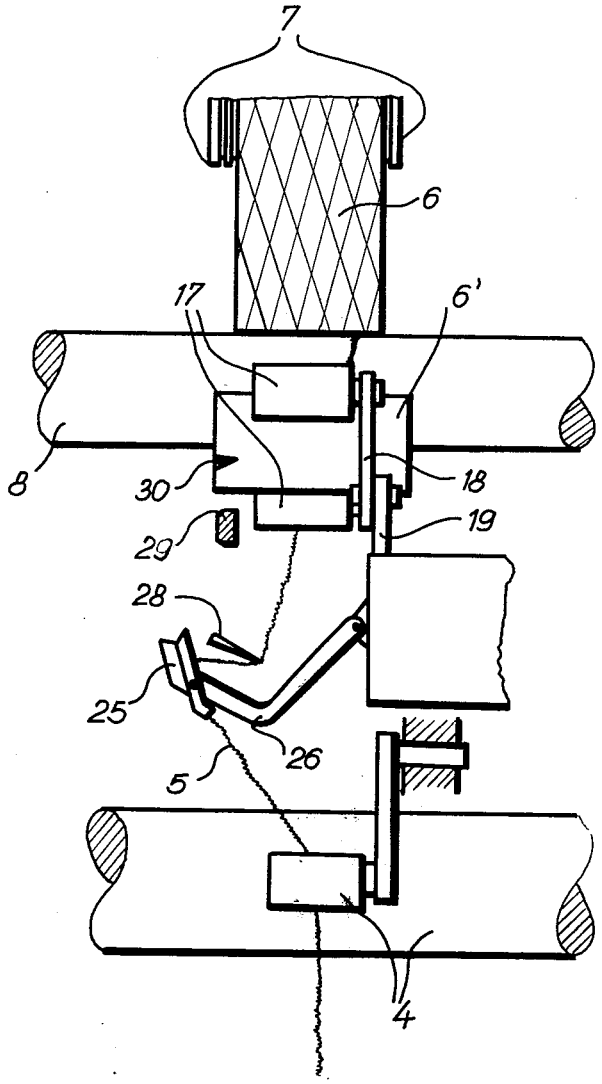
FIGS. 6, 7, 8 and 9 are all fragmentary detailed front views, showing details of the apparatus in FIG. 1 in particular working phases.
Figure 8:
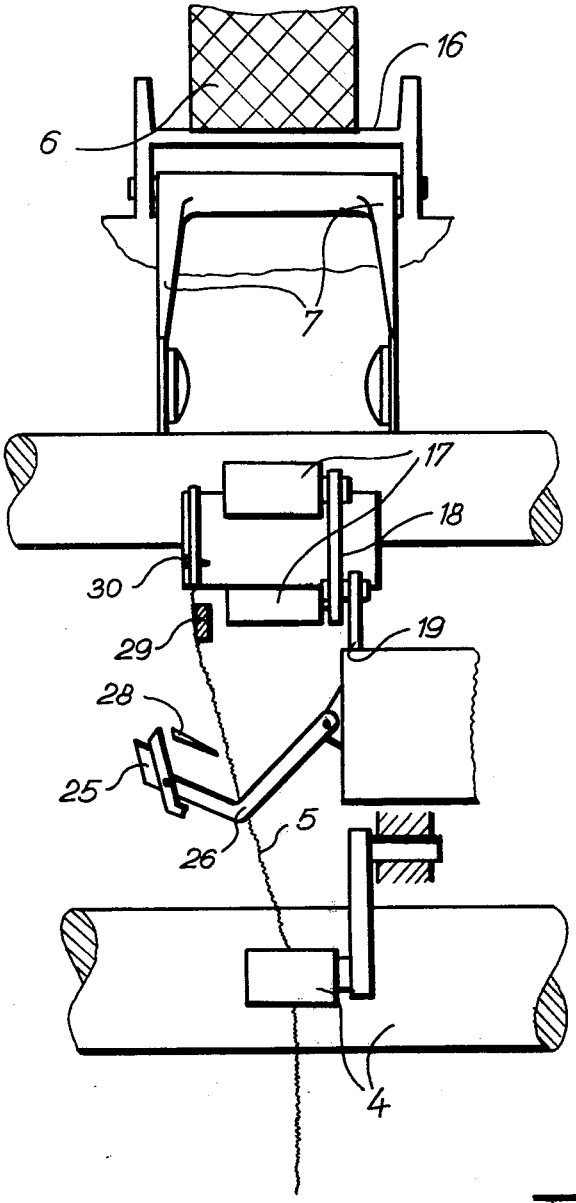

The yarn inserting means includes a deflector 29 which is shown in FIGS. 6, 7 and 8 and serves to deflect the yarn 5 during the formation of a yarn reserve, so that the yarn will be deflected against an edge of the bobbin 6'. In the illustrated embodiment the deflector 29 is tiltable. The deflector holds the yarn fixed to the axial end of the empty bobbin, adjacent this end, so that the yarn begins to be wound onto the bobbin and the reverse is formed. During winding of the yarn reserve, the deflector is immovable and assumes the position shown in full line in FIG. 3. After the yarn reserves has been wound, the deflector moves into the position shown in dotted lines in FIG. 3 where it no longer interferes with the yarn path and thus no longer contributes to the formation of a yarn reserve. During the movement of the empty bobbin from the position shown in FIG. 3 to the winding position shown, for example, in FIGS. 5 and 13, that is to the position which is also assumed by the full bobbin prior to the exchange, the yarn displacement towards the left will automatically cause the yarn to slide off the deflector and to simultaneously enter the traversing groove 9 of the drum 8.

All of the components, or rather the mechanisms which have been referred to above, are arranged to be driven by an electric motor via controlling means which is not separately described or illustrated, because such means comprises conventional components such as cams, gears, lever transmissions or the like which are well known to those skilled in the art and are not necessary for an understanding of the principle of the invention, or the operation thereof. However, for the sake of clarity, it is pointed out that cams 15 and 21 are driven by a timing belt 51 meshing with gear wheels 53 and 54 that are mounted on the shafts of cams 15 and 21, respectively. The cam 26 is driven from cam 55 the shaft of which carries a gear wheel that meshes with belt 51. A swingable arm 57 has a follower 58 that engages cam 55; a rack 59 is linked to arm 57 and meshes with gear wheel 60 on the shaft that supports the arm 26. Deflector 29 is driven by a cam 61 having a front groove 62 in which a peg 63 engages that is coupled with deflector 29. Cam 61 is also driven by belt 51.

In the operation of the embodiment thus far described, the apparatus is started up. As a rule, but not necessarily, this is the result of the issuance of a signal derived from a package-diameter sensor, or else a machine operator may manually provide a signal when it is time to exchange the full bobbin for an empty one. The apparatus may also carry out the bobbin exchange successively along the entire machine, hence the rolls 11 and the rails 12, so that it can move along the machine to successively change the bobbins on the spinning units which are arranged-by-side in the machine.

In any case, in the starting position of the apparatus the ejecting arm 14 is in one of its extreme positions; this position is shown in solid lines in FIG. 3. The empty bobbin 6' is rolled on the rolls 17 of the bobbin supplying device 4 (see FIG. 4) while the extension 23 of the lever 18 bears on the abutment 24. The open gripper 25 is located in its lower or starting position. The deflector 29 is in its upper position. The yarn traversing drum 8, the full bobbin 6 and the take-off rollers 4 rotate, at this time, in the directions indicated by the respective arrows.

The bobbin exchanging operation begins when the reciprocatory bar 19 starts to move upwardly, as it disengages the extension 23 of the lever 18 from the abutment 24. As this takes place, the lever 18 is swung under the action of the spring 22 is counterclockwise direction until it reaches the position shown in FIG. 3. In this position, the rolls 17 force the empty bobbin 6' against the yarn traversing drum 8 which now begins to rotate the bobbin 6' at the winding speed. At the same time, the arm 26 which carries the gripper 25 between the open jaws of which the yarn 5 passes, is swung from its lower extreme position shown in FIG. 4, thus becoming disengaged from the abutment 27 so that the release jaw 25'' tilts down and the yarn 5 is gripped. During the swinging movement of the arm 26, the now engaged yarn 5 is moved substantially at the take-off speed at which it is derived from the rollers 4.

FIG. 6 shows that before the gripper 25 has reached its upper position, the yarn 5 will contact the cutting edge 28 which severs it. The upper end of the severed yarn 5 is wound around the full bobbin 6 while the lower end forms a free yarn end which will be inserted into the interior of the empty bobbin 6' (see FIGS. 3 and 7) by means of the gripper 25. The empty bobbin 6' is provided at its edge with a notch 30 and as the yarn 5 is dragged over this edge of the rotating bobbin 6', it will become entrapped in the notch 30 and winding of the yarn onto the bobbin 6' will commence. As the yarn bears against the deflector 29, it is wound around the marginal portion of the bobbin 6' which is designed to receive the yarn reserve as shown in FIG. 8.

The notch 30 could be replaced with a protuberance, or the edge of the bobbin 6' could be roughened, serrated or the like to serve the same purpose as the notch 30, namely to entrain the yarn.

Figure 9:
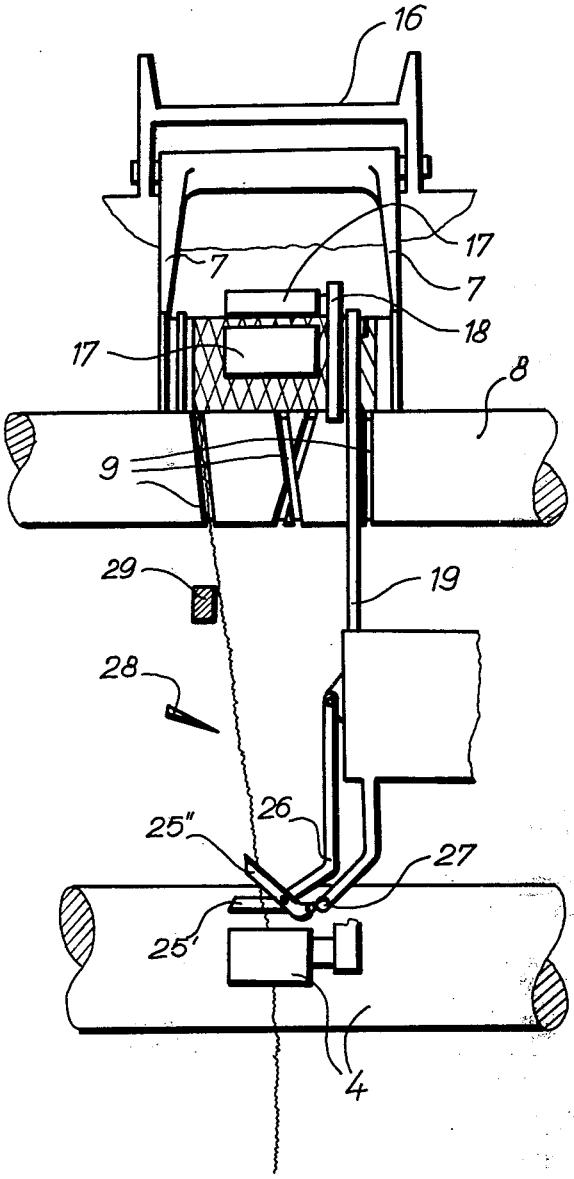

During the continued upward movement of the reciprocatory bar 19, the empty bobbin 6' which already rotates at the winding speed is rolled on the surface of the yarn traversing drum 8 and displaced into its working position which is shown in FIGS. 5 and 9. In this position, it is seized by the arms 7. Due to this change of the position of the bobbin 6', the yarn 5 slips off the deflector 29 and immediately enters the yarn traversing groove 9 of the drum 8 which now distributes it to and from along the length of the bobbin 6', so that a cross-wound package is formed as shown in FIG. 9. The bobbin exchanging operation is now finished and the mechanisms are returned to their respective starting positions.

In certain types of machines, or certain circumstances, higher spinning speeds are used. If so, it is desirable that the yarn reserve operation be finished before the yarn reserve attains an excessive length. In other words, the reserve winding operation should be finished while the bobbin supply mechanism is still in its intermediate position in which the deflector 29 keeps the yarn 5 in position adjacent the edge of the bobbin 6'. In this case, after the predetermined yarn reserve length has been wound onto the bobbin 6', the deflector 29 tilts down so that the yarn 5 reaches the middle of the bobbin 6' by forming several helical coils about the latter, before the bobbin 6' is displaced to its working position.

Figure 11:
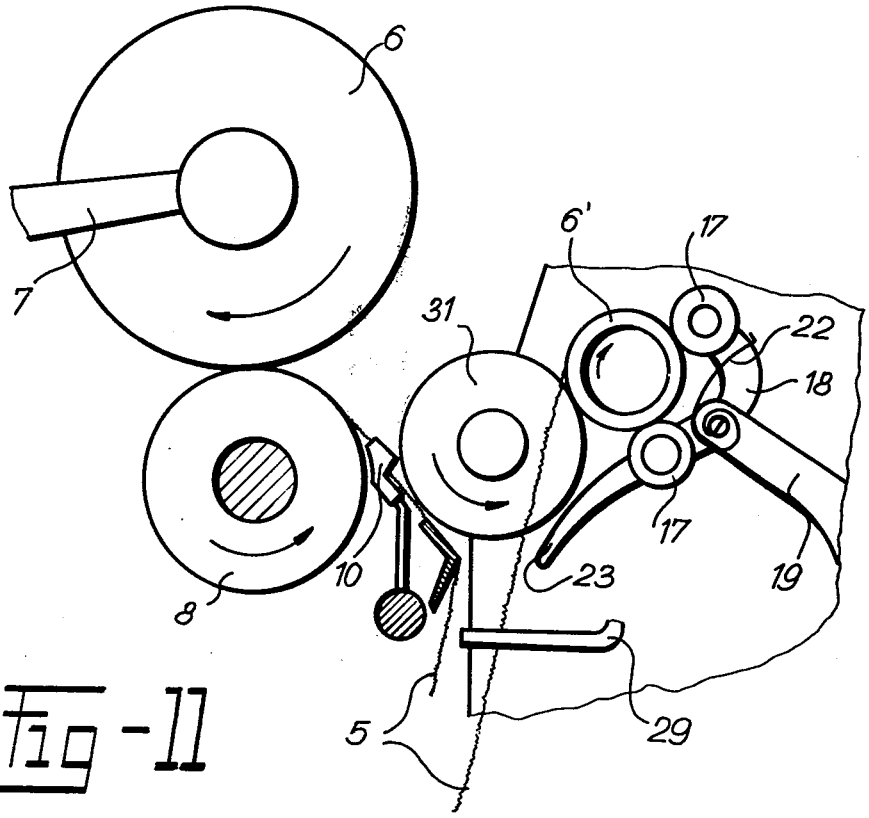
FIGS. 11, 12 and 13 are partly sectioned detailed side views of a different embodiment of the present invention, installed on the apparatus shown in FIG. 2 and illustrating particular working phases.
Figure 12:
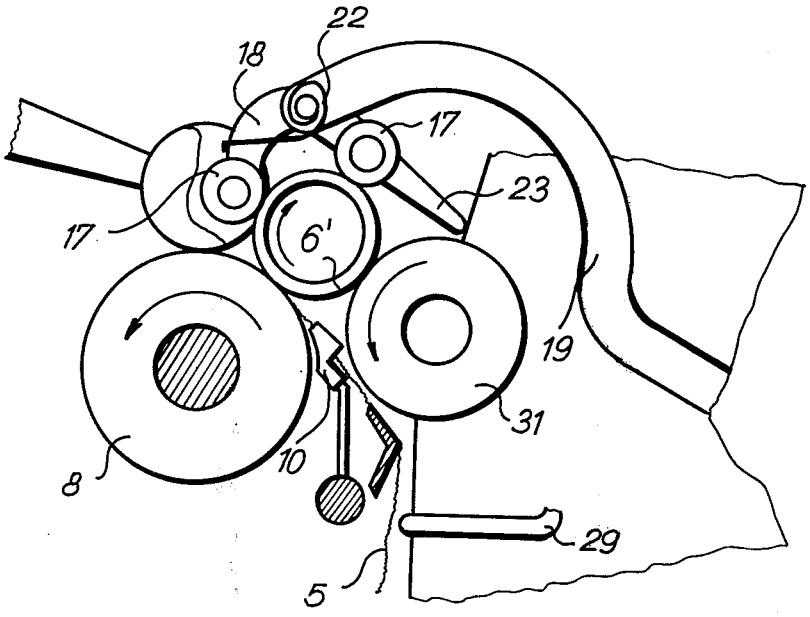
Figure 13:
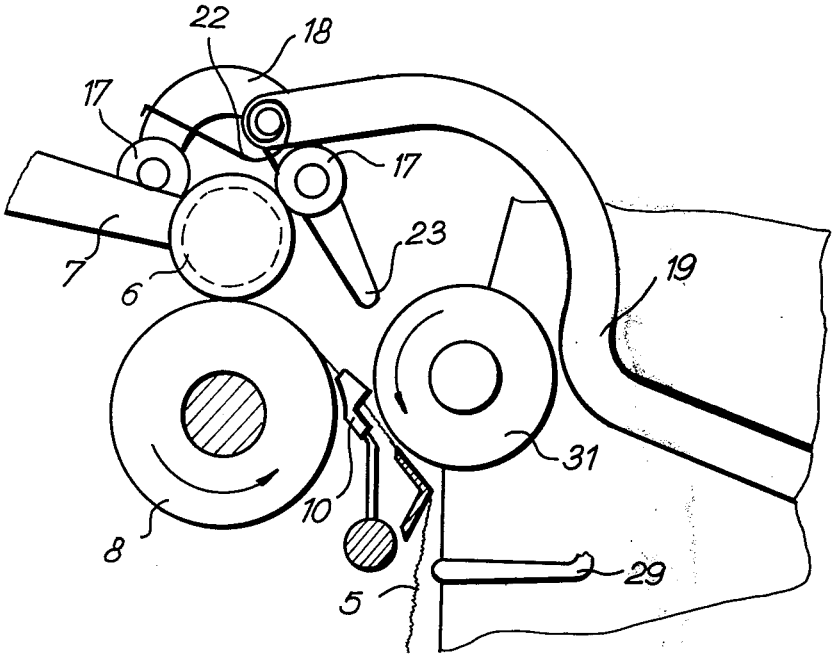

FIGS. 11, 12 and 13 show a further embodiment of the invention, illustrating it in three different operating phases. Here, the device for predriving the empty bobbin 6' during the bobbin changing operation uses an auxiliary drum 31 which is driven at the winding speed and is narrower than the empty bobbin 6', thus enabling the yarn 5 to pass over to the yarn driving drum 8. It should be understood that the drum 31 could be replaced by an endless driven belt. This embodiment is particularly advantageous for use in open-end spinning machines wherein the yarn 5 is distributed along the bobbin 6' by a reciprocatory yarn guide 10 (i.e. the type of machine shown in FIG. 2), because the yarn guide 10 prevents the empty bobbin 6' from being forced in the intermediate position, against the surface of the drum 8 which is accessible only from above due to the presence of the full bobbin 6. Thus, in this embodiment the rolls 17 force the empty bobbin 6' first against the auxiliary drum 31 alone (see FIG. 11), thereupon both against the yarn driving drum 8 and the auxiliary drum 31 (FIG. 12), and finally only against the yarn traversing drum 8 (FIG. 13).

Figure 14:
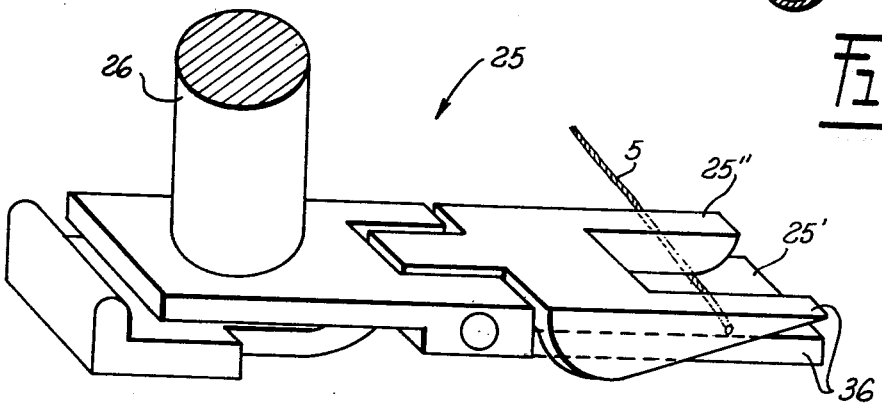
FIG. 14 is a partly sectioned perspective view showing an embodiment of a yarn gripper seen from one side.
Figure 15:
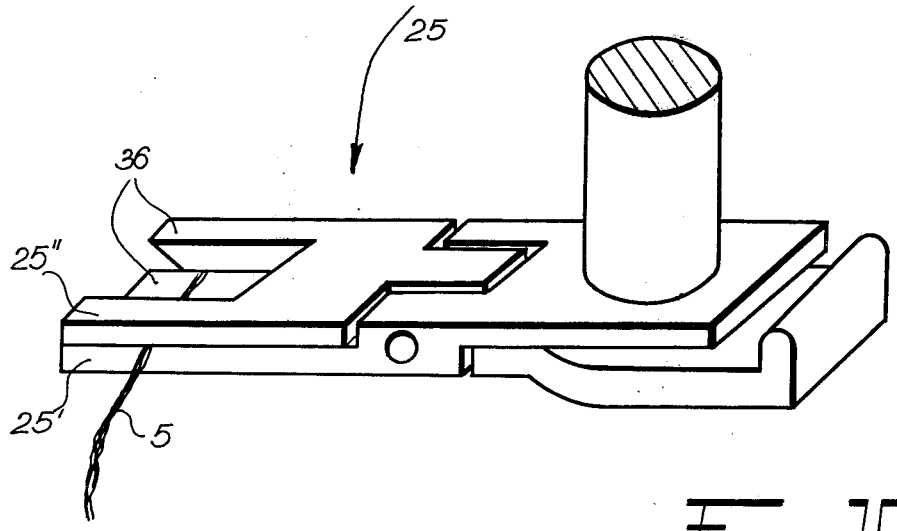
FIGS. 15 and 16 are two partly sectioned perspective views, showing different yarn gripper embodiments, FIG. 15 showing the gripper of FIG. 14 from the other side.

Coming to FIGS. 14 and 15, it will be seen that a gripper 25 as illustrated therein is provided with one pair of clamping jaws 25'and 25'', and one pair of severing jaws 36. The operation of gripper 25 is self-evident.

Figure 16:
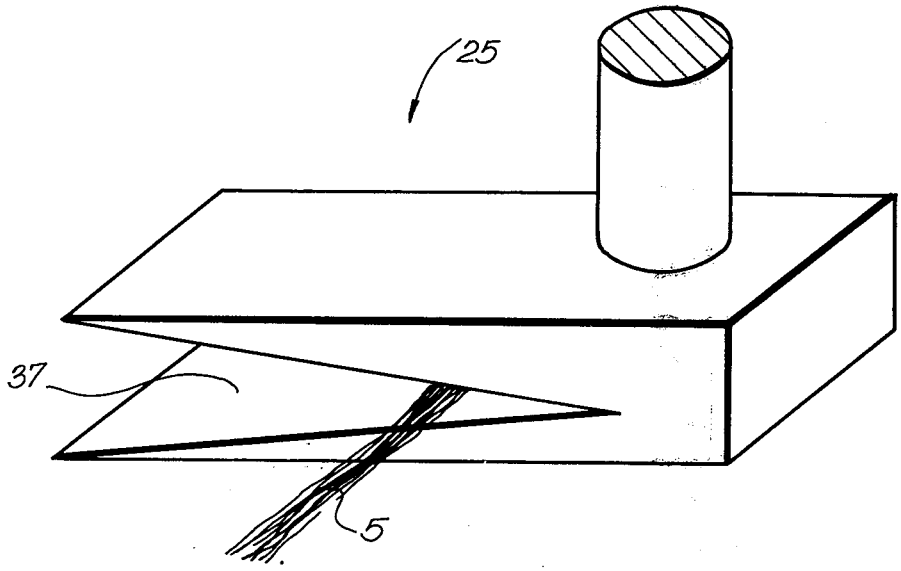

FIG. 16 shows a different embodiment of the gripper 25, wherein the gripper is provided with a body having a V-shaped groove 37 the walls of which include an acute self-locking angle designed to entrap the yarn 5, particularly yarns of a coarser count. No severing jaws are provided.

Figure 17:
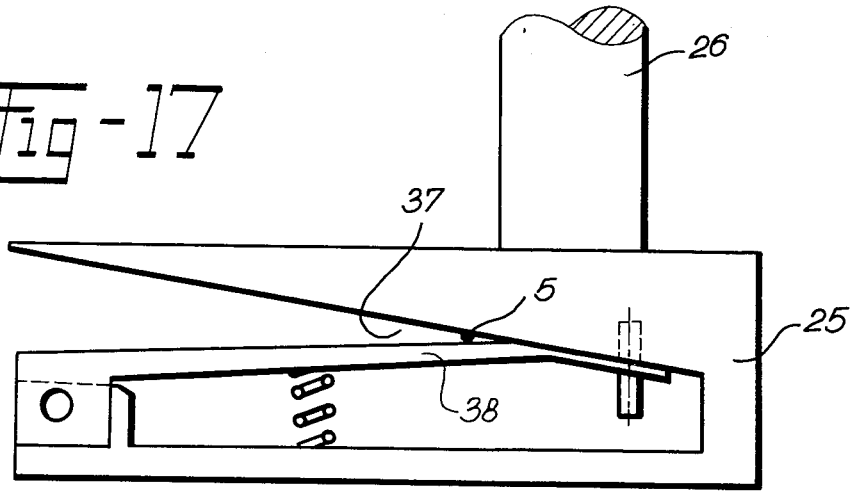
FIG. 17 is a side view, showing still a further yarn gripper embodiment.

If the yarns are of a finer count, then it is preferable to use the embodiment in FIG. 17, wherein the gripper 25 is provided with a body having a V-shaped groove one wall of which is fixed, while the second is constituted by a spring-loaded plate 38 to provide for better entrapping of the yarn 5. No severing jaws are provided.

Figure 18:
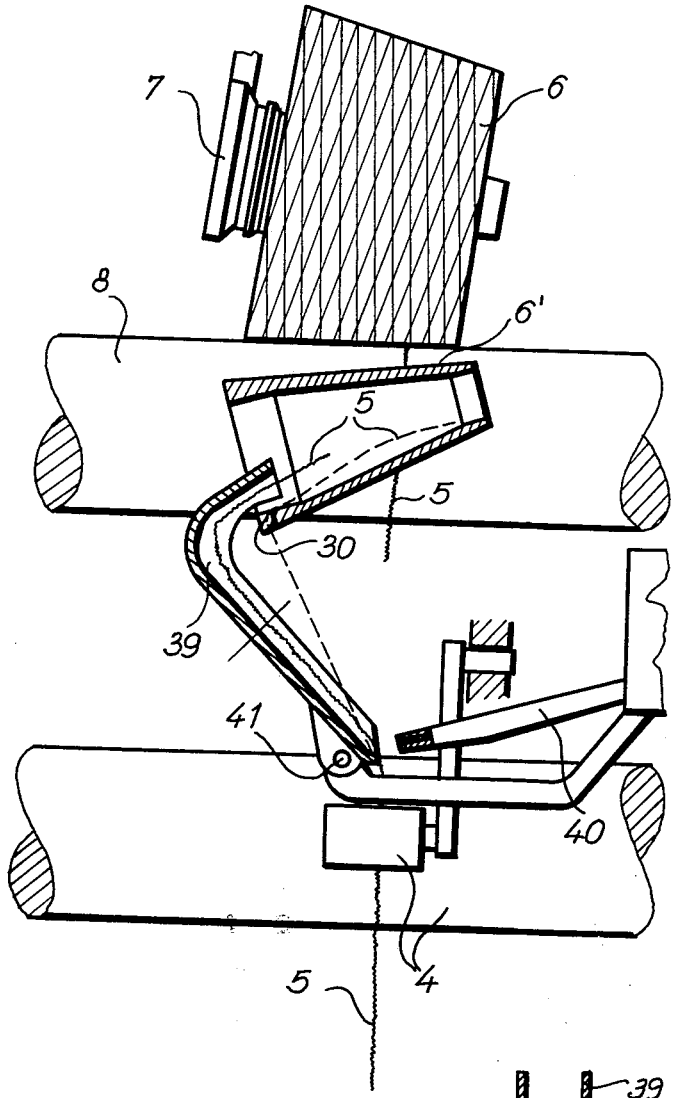
FIGS. 18, 19, 20, 21 and 22 show views in partly sectioned form, of different embodiments of pneumatic yarn inserting mechanism, FIGS. 19 and 21 being cross-sectional detent views of FIGS. 18 and 20, respectively.
Figure 19:
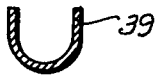

FIGS. 18 and 19 show means for inserting the end of the yarn 5 into the interior of the empty bobbin 6'. Here, this means is constituted by an air duct 39 provided in its circumferential wall with a longitudinal slot to enable the yarn 5 to slip out of the duct 39. The inlet end of the duct is disposed adjacent the take-off rollers 4 and receives an end of a tube 40 which supplies a pressurized medium into the inlet end of the duct 39. The outlet end of the duct 39 is arcuately shaped, so that it can enter the interior of the empty bobbin 6'. The air duct 39 is supported on a pivot 41, permitting it to tilt. In operation, and after the yarn 5 has been severed, its free end is entrained by an airstream which enters through the tube 40 into the inlet end of the duct 39. It is carried along in the duct 39 and finally enters into the interior of the rotating bobbin 6'. Due to a drag which acts upon the yarn 5, it straightens out and slips out of the duct 39 as shown by the broken line in FIG. 18. In so doing it contacts an edge at the axial end of the bobbin 6', and is entrapped there by a notch 30 which is formed in this edge, so that winding of the yarn onto the bobbin 6' commences.

Figure 21:
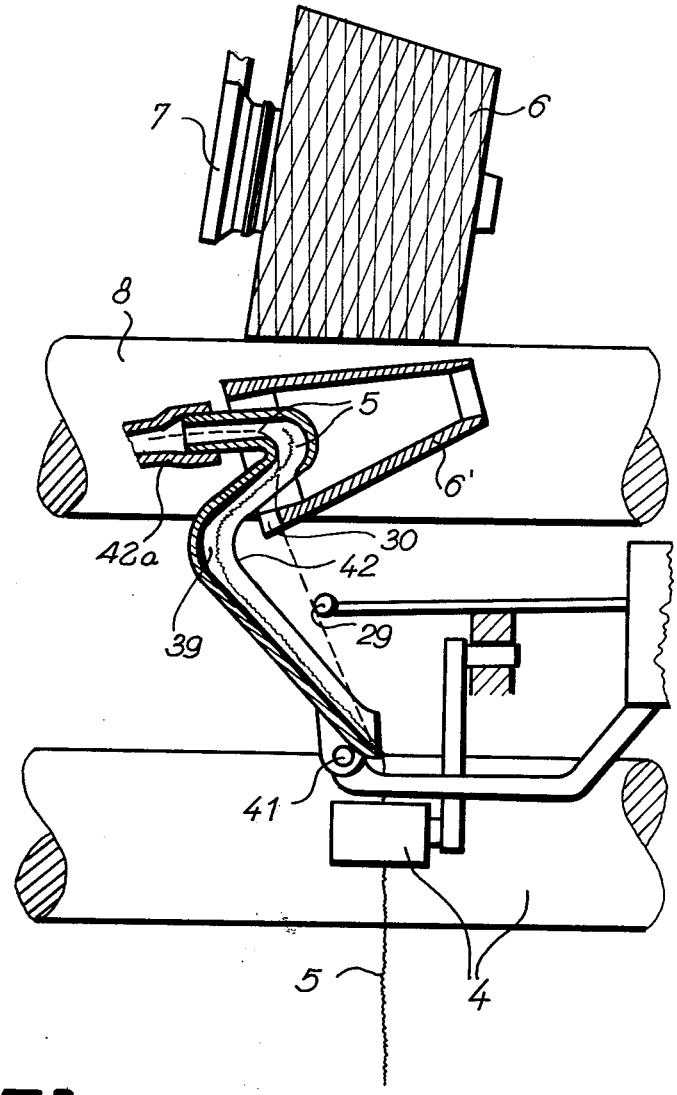
Figure 20:
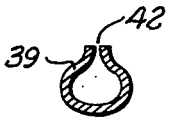
Figure 22:
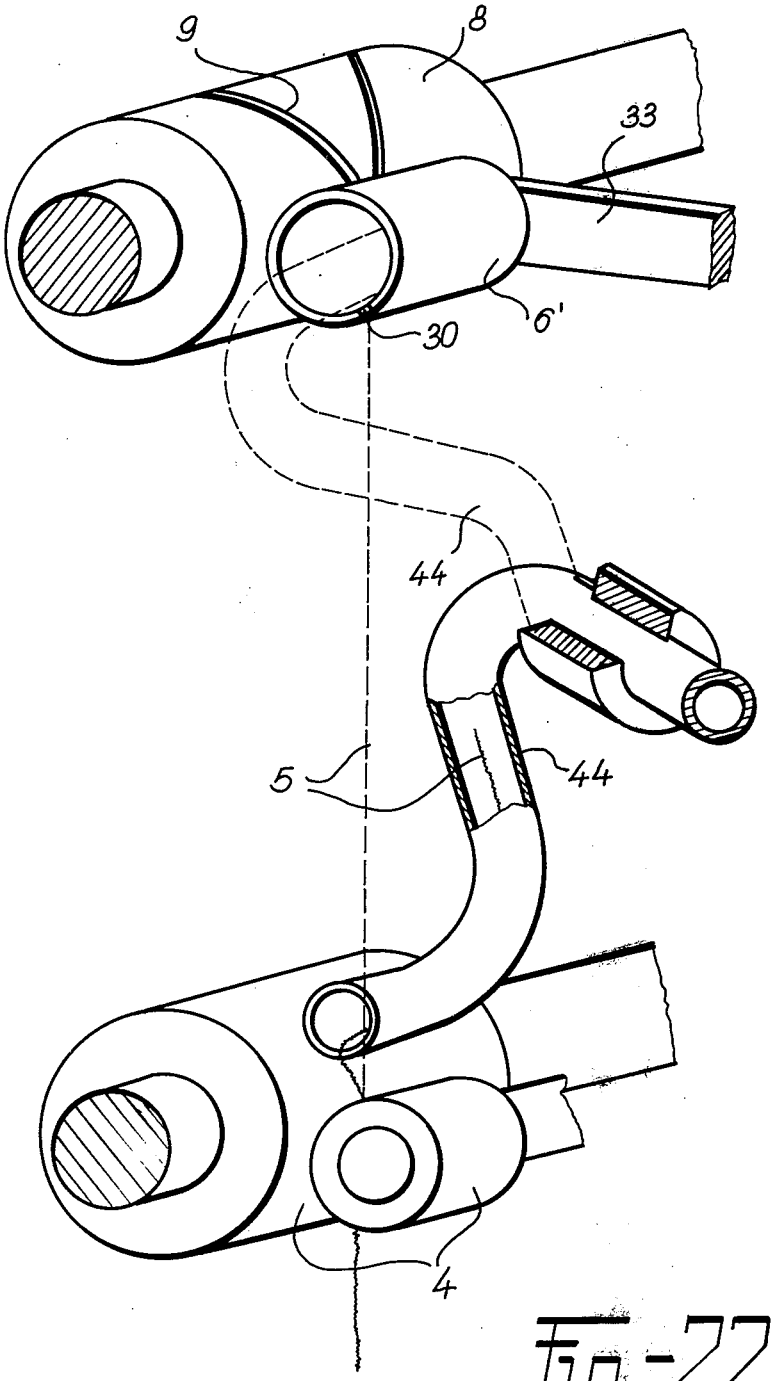

FIGS. 20 and 21 show a somewhat different embodiment, wherein the duct 39 is formed as a Z-shaped tube which is partly formed with a longitudinal slot 42*a*. The outlet end portion of the duct 39 communicates with a vacuum tube 42 which aspirates yarn into the interior of the duct 39. As soon as the upper end of the yarn has reached the upper non-slotted portion of the duct 39, the yarn 5 straightens out because of the drag exerted upon it. It now slips off through the slot 42, leaving the duct 32 and assuming the position shown in broken lines in FIG. 20. In this position it is again engaged by the notch 30 of the bobbin 6'.

A further embodiment of yarn inserting means is shown in FIG. 21, using an S-shaped tube 44 which communicates with a source of sub-atmospheric pressure, this is a source of suction. The tube 44 is movable between two extreme positions. One of these is a starting position in which the inlet portion of the tube 44 is located adjacent the take-off rollers 4. In the working position which is shown in broken lines, the inlet portion of the tube 44 with the aspirated yarn end portion of the yarn 5 extends into the interior of the bobbin 6'.

Figure 23:
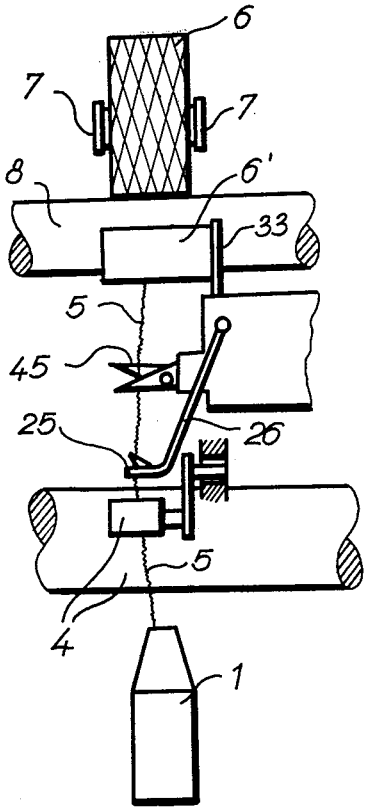
FIGS. 23, 24 and 25 show several embodiments of yarn severing means, in fragmentary sectional views.

The yarn severing means for severing the yarn intermediate the full bobbin 6 and the take-off roller 44 may be configurated as a cutting blade as shown in FIG. 3, or as a pair of shears 45 as shown in FIG. 23. These shears sever the yarn at intervals that are program controlled, for example, by means of a cam which can be controlled analogously to the other cams shown in FIG. 3, i.e., via a timing belt and a gear wheel.

Figure 24:
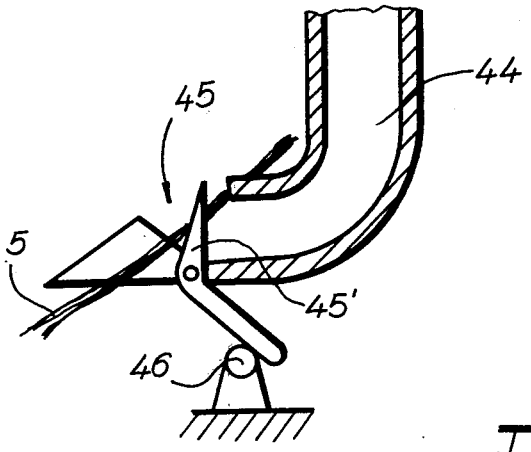

FIG. 24 shows a further possibility, namely that the shears 45 may be provided on the vacuum yarn inserting means. In this case, the movable jaw 45' of the shears 45 is spring loaded and is arrested in its starting position by a stop 46.

Figure 25:
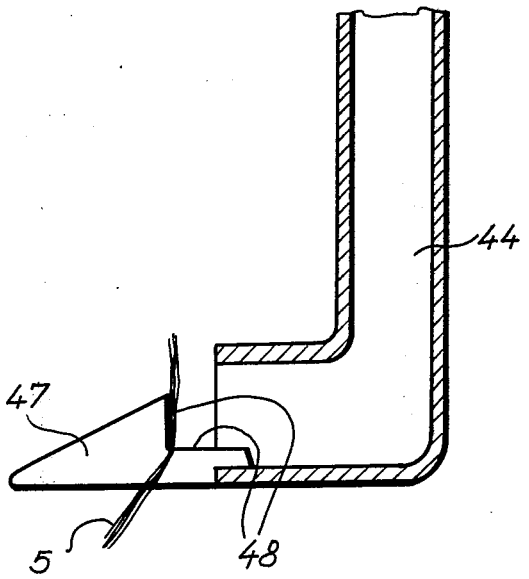

FIG. 25 shows that if desired the shears 45 could be replaced by a knife 47, having a cutting blade 48. The knife may be fixedly attached to the vacuum yarn inserting means.

It will be understood that each of the elements described above, or two or more together, may also find a useful application in other types of applications differing from the types described above.

While the invention has been illustrated and described as embodied in a bobbin replacing apparatus in a textile machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an open-end spinning machine, a combination comprising first means for engaging a first bobbin and rotating the same as a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed; fourth means for severing the advancing yarn from the yarn package on said first bobbin, so as to form a free yarn end on the advancing yarn; fifth means for inserting said free yarn end substantially at the take-off speed into the interior of the rotating second bobbin for entrapping and taking up of a yarn reserve by the same, said fifth means comprising a yarn gripper movable between one position in which it engages the free yarn end, and another position in which it is located in the interior of said bobbin with said free yarn end; and sixth means for replacing said first bobbin having said yarn package thereon with the rotating empty second bobbin on said first means.

2. A combination as defined in claim 1, wherein said yarn gripper comprises a fixed jaw, a movable jaw which is spring-biased into and movable out of contact with said fixed jaw, and actuating means for moving said movable jaw out of contact with said fixed jaw.

3. A combination as defined in claim 1, wherein said yarn gripper has a V-shaped groove which is bounded by said jaws which form an acute angle with one another.

4. A combination as defined in claim 3, wherein said movable jaw is a spring-biased plate.

5. In an open-end spinning machine, a combination comprising first means for engaging a first bobbin and rotating the same at a predetermined speed in preparation for taking up a yarn thereon; second means for continuously advancing a yarn at a constant speed corresponding to the take-up speed, to said first bobbin so that the yarn can be wound onto the same to form a yarn package; third means for rotating an empty second bobbin at said predetermined speed; fourth means for severing the advancing yarn from the yarn package on said first bobbin, so as to form a free yarn end on the advancing yarn; fifth means for inserting said free yarn end substantially at the take-off speed into the interior of the rotating second bobbin for entrapping and taking up of a yarn reserve by the same, said fifth means comprising a yarn gripper movable between one position in which it engages the free yarn end, and another position in which it is located in the interior of said bobbin with said free yarn end; and sixth means for replacing said first bobbin having said yarn package thereon with the rotating empty second bobbin on said first means.

6. A combination as defined in claim 5, said fifth means further comprising a source of compressed fluid which discharges into said inlet so as to advance said free yarn end and insert it into said conduit.

7. A combination as defined in claim 5, said fifth means further comprising a source of suction communicating with said outlet of said conduit, for producing suction in the latter and aspirating said free yarn end into said inlet.

8. In an open-end spinning machine, a combination comprising first means for engaging a first bobbin and rotating the same at a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed; fourth means for severing the advancing yarn from the package on said first bobbin, so as to form a free yarn on the advancing yarn; fifth means for inserting said free yarn end substantially at the take-off speed into the interior of the rotating second bobbin for entrapping and taking up of a yarn reserve by the same, said fifth means comprising a yarn gripper movable between one position in which it engages the free yarn end, and another position in which it is located in the interior of said bobbin with said free yarn end; and sixth means for replacing said first bobbin having said yarn package thereon with the rotating empty second bobbin on said first means.

9. In an open-end spinning machine using tubular bobbins each having a marginal portion bounding one axial end of the bobbin and provided with a notch, a combination comprising first means for engaging a first bobbin and rotating the same at a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed; fourth means for severing the advancing yarn from the yarn package on said first bobbin, so as to form a free yarn end on the advancing yarn; fifth means operative for inserting said free yarn end substantially at the take-off speed into the interior of the rotating second bobbin and positioning it so that it may be caught by said notch for entrapping by said bobbin and taken up of a yarn reserve by the same; and sixth means for replacing said first bobbin having said yarn package thereon with the rotating empty second bobbin on said first means.

10. In an open-end spinning machine using tubular bobbins each having a marginal portion which bounds one axial end of the bobbin and is formed with a roughened edge, a combination comprising first means for engaging a first bobbin and rotating the same at a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed; fourth means for severing the advancing yarn from the yarn package on said first bobbin, so as to form a free yarn end of the advancing yarn; fifth means for inserting said free yarn end substantially at the take-off speed into the interior of the rotating second bobbin using tubular bobbins each having a marginal portion which bounds one axial end of the bobbin and is formed with a roughened edge for entrapping of the yarn by said bobbin and taking up of a yarn reserve by the same; and sixth means for replacing said first bobbin having said yarn package thereon with the rotating empty second bobbin on said first means.

11. In an open-end spinning machine using tubular bobbins each having a marginal portion which bounds one axial end of the bobbin and is provided with a protuberance, a combination comprising first means for engaging a first bobbin and rotating the same at a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed; fourth means for severing the advancing yarn from the yarn package on said first bobbin, so as to form a free yarn on the advancing yarn; fifth means for inserting said free yarn end substantially at the take-off speed into the interior of the rotating second bobbin and for positioning the free yarn end so that it may be engaged and entrained by said protuberance for entrapping of the yarn by said bobbin and taking up of a yarn reserve by the same; and sixth means for replacing said first bobbin having said yarn package thereon with the rotating empty second bobbin on said first means.

12. In an open-end spinning machine, a combination comprising first means for engaging a first bobbin and rotating the same at a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed, said third means comprising two rolls, a spring biased toggle lever mounting on each of its arms one of said rolls, a bar supporting said lever and adapted to reciprocate between one end position in which said rolls are prepared to receive the empty bobbin, at least one intermediate position in which said rolls urge said empty bobbin into motion-receiving engagement with said bobbin-driving element, and another end position in which the rotating empty bobbin is engaged by said first means; fourth means for severing the advancing yarn from the yarn package on said first bobbin, so as to form a free yarn end on the advancing yarn; fifth means for inserting said free yarn end substantially at the take-off speed into the interior of the rotating second bobbin for entrapping and taking up of a yarn reserve by the same; and sixth means for replacing said first bobbin having said yarn package thereon with the rotating empty second bobbin on said first means.

13. A combination as defined in claim 12, said lever being spring-biased in one direction; and further comprising an abutment for limiting the pivoting of said lever in said one direction.

14. In a method of operating an open-end spinning machine, the steps of continuously advancing a yarn towards a takeup station at a constant speed corresponding to the takeup speed; winding the advancing yarn at said station onto a bobbin which rotates at a predetermined speed so that a yarn package is formed on the bobbin until the latter is full; rotating an empty bobbin and accelerating it to said predetermined speed; severing the advancing yarn from the yarn package on the full bobbin to provide a free yarn end; seizing said free yarn end and displacing it at a constant speed corresponding to the takeup speed to the rotating empty bobbin; inserting said free yarn end substantially at the takeup speed into the rotating empty bobbin at one axial end of the empty bobbin; entrapping the yarn at said axial end; looping the yarn from said axial end onto a periphery of the rotating empty bobbin; commencing winding of several yarn coils onto the rotating empty bobbin; releasing said free yarn end, and replacing the full bobbin at said station with said rotating empty bobbin.

15. In an open-end spinning machine, a combination comprising first means for engaging a first bobbin and rotating the same at a predetermined speed in preparation for taking up a yarn thereon; second means for continuously advancing a yarn at a constant speed corresponding to the takeup speed, to said first bobbin so that the yarn can be wound onto the same and form a yarn package; third means for rotating an empty second bobbin at said predetermined speed; fourth means for severing the advancing yarn from the yarn package on said first bobbin, so as to form a free yarn end on the advancing yarn; fifth means for seizing said free yarn end and displacing it at a constant speed corresponding to the takeup speed to the rotating empty bobbin, and for thereupon inserting said free yarn end substantially at the take-off speed into the interior of the rotating second bobbin for entrapping of the yarn by the same, looping of the yarn from said axial end onto the bobbin periphery and winding of several yarn coils onto the periphery prior to release of said free yarn end; and sixth means for replacing said first bobbin having said yarn package thereon with the rotating empty second bobbin on said first means.

16. A combination as defined in claim 15, wherein said third means comprises a bobbin-driving element, and means for supplying the empty bobbin and for urging the same into motion-receiving engagement with said element.

17. A combination as defined in claim 15, wherein said bobbins are tubular and each have a marginal portion which bounds one axial end of the respective bobbin; and wherein said fifth means comprises a deflector for deflecting said free yarn end towards said marginal portion.

18. A combination as defined in claim 17, wherein said deflector is tiltable between an operative position in which it deflects said free yarn end towards said marginal portion, and a withdrawn inoperative position.

19. A combination as defined in claim 15, wherein said fourth means is provided on said fifth means, and wherein said fifth means is operative for inserting said free yarn end into one axial end of the respective tubular bobbins.

20. A combination as defined in claim 15, wherein said second means comprises a pair of take-off rollers.

* * * * *